US006793291B1

(12) United States Patent
Kocher

(10) Patent No.: US 6,793,291 B1
(45) Date of Patent: Sep. 21, 2004

(54) VEHICLE BODY ARMOR SUPPORT SYSTEM (V-BASS)

(76) Inventor: Robert William Kocher, 4828 3rd St. North, Arlington, VA (US) 22203

( * ) Notice: Subject to any disclaimer, the term of this patent is extended or adjusted under 35 U.S.C. 154(b) by 111 days.

(21) Appl. No.: 09/925,436

(22) Filed: Aug. 10, 2001

(51) Int. Cl.[7] ..... A47C 31/00; B60R 21/12

(52) U.S. Cl. ..... 297/464; 297/465; 2/462; 280/748

(58) Field of Search ..... 297/464, 465; 2/462; 280/748, 751

(56) References Cited

U.S. PATENT DOCUMENTS 3,179,360 A * 4/1965 Shelton et al. ..... 297/465
3,278,230 A * 10/1966 Boyce et al. ..... 297/465
3,827,716 A * 8/1974 Vaughn et al. ..... 280/730.1
4,299,406 A * 11/1981 Thomas ..... 297/464
4,923,147 A * 5/1990 Adams et al. ..... 244/122 AG
5,180,880 A * 1/1993 Zufle ..... 89/36.02
5,479,659 A * 1/1996 Bachner, Jr. ..... 2/2.5

* cited by examiner

*Primary Examiner*—Anthony D. Barfield

(57) ABSTRACT

The Vehicle Body Armor Support System (V-BASS) significantly enhances the survivability of vehicle crewmembers and occupants in aircraft and ground vehicles from high velocity projectiles such as shrapnel or bullets at minimum weight burden on the vehicle occupants. Current heavy body armor systems weigh 20 to 40 pounds. The majority of this weight is carried on the vehicle occupant's torso and transferred through the occupant'spine to the seat. The Vehicle Body Armor Support System invention allows the direct transfer of the heavy body armor system's weight directly to the seat or other points in the vehicle without burdening the occupant. This invention is comprised of a vehicle platform; an occupant seat supported by the vehicle platform; an occupant armor component carried on the occupant designed in such a fashion to transfer the weight of the armored component from the occupant to the seat or other points in the vehicle.

12 Claims, 10 Drawing Sheets

VEHICLE BODY ARMOR SUPPORT SYSTEM (V-BASS)

CROSS REFERENCE TO RELATED APPLICATIONS

Not Applicable.

STATEMENT REGUARDING FEDERALLY SPONSORED RESEARCH OR DEVELOPMENT

Not Applicable.

REFERENCE TO A MICROFICHE APPENDIX

Not Applicable.

BACKGROUND OF INVENTION

Various systems for protecting vehicle occupants from ballistic threats are described in my U.S. Pat. No. 6,129,383. As set forth in my '383 patent, armor systems for protecting crew members and occupants of aircraft and ground vehicles (hereinafter referred to as vehicle occupants) from high velocity projectiles such as shrapnel or bullets has traditionally involved expensive options. Vehicle occupants are extremely vulnerable from small arms, anti-aircraft fire or landmines. Since armor is relatively heavy, armoring large sections of aircraft becomes weight prohibitive. Ground vehicle occupants such as trucks, jeeps, or cars are in a similar situation therefore can utilize similar vest approaches found on aircraft. Heavy vests are feasible solutions since the vehicle occupants are normally seated and engage in limited activity. The problem with the heavy body armor arises during extended wear or over rough raveling conditions. The body armor's additional weight bears down on the wearers spine, causes rubbing on the wearer's back and chest, and if worn loosely, can impact on the wearer's upper thighs. During severe bumps, hard landings, or traveling over rough terrain, the increased body armor weight could contribute to serious spine injuries or death. The present invention eliminates such problems by providing an armored vest arrangement comprising front and back plates of an armored vest worn by an occupant in a vehicle. The back plate is configured to extend and rest on a vehicle seat and a load transferring mechanism is provided between the front and back plates. The front plate is supported through the load transferring mechanism on the back plate for transferring the weight of the front plate to the back plate and thence to the vehicle through the seat.

REFERENCE NUMERALS IN DRAWING

Item 1 is the ballistic back plate.
Item 2 is the ballistic front plate.
Item 3 is a strap connecting front and back plates over the wearer's shoulders.
Item 4 is a strap connecting the front and back plates near the wearer's mid-torso.
Item 5 is the vehicle seat.
Item 6 is the wearer's leg.
Item 7 is the front plate top support arm.
Item 8 is the front plate center of legs support.
Item 9 is the vehicle seat back.
Item 10 is a connector to attach the back plate to the seat.
Item 11 is a connector that attaches the back plate to the base of the vehicle seat.
Item 12 is a tripod support connecting the ballistic system to a vehicle attachment point.
Item 13 is a roof or roof hatch support for the ballistic system.

DESCRIPTION OF PREFERRED EMBODYMENTS a. The Ballistic Front Plate with Between-the-legs-support.

Figure 1:
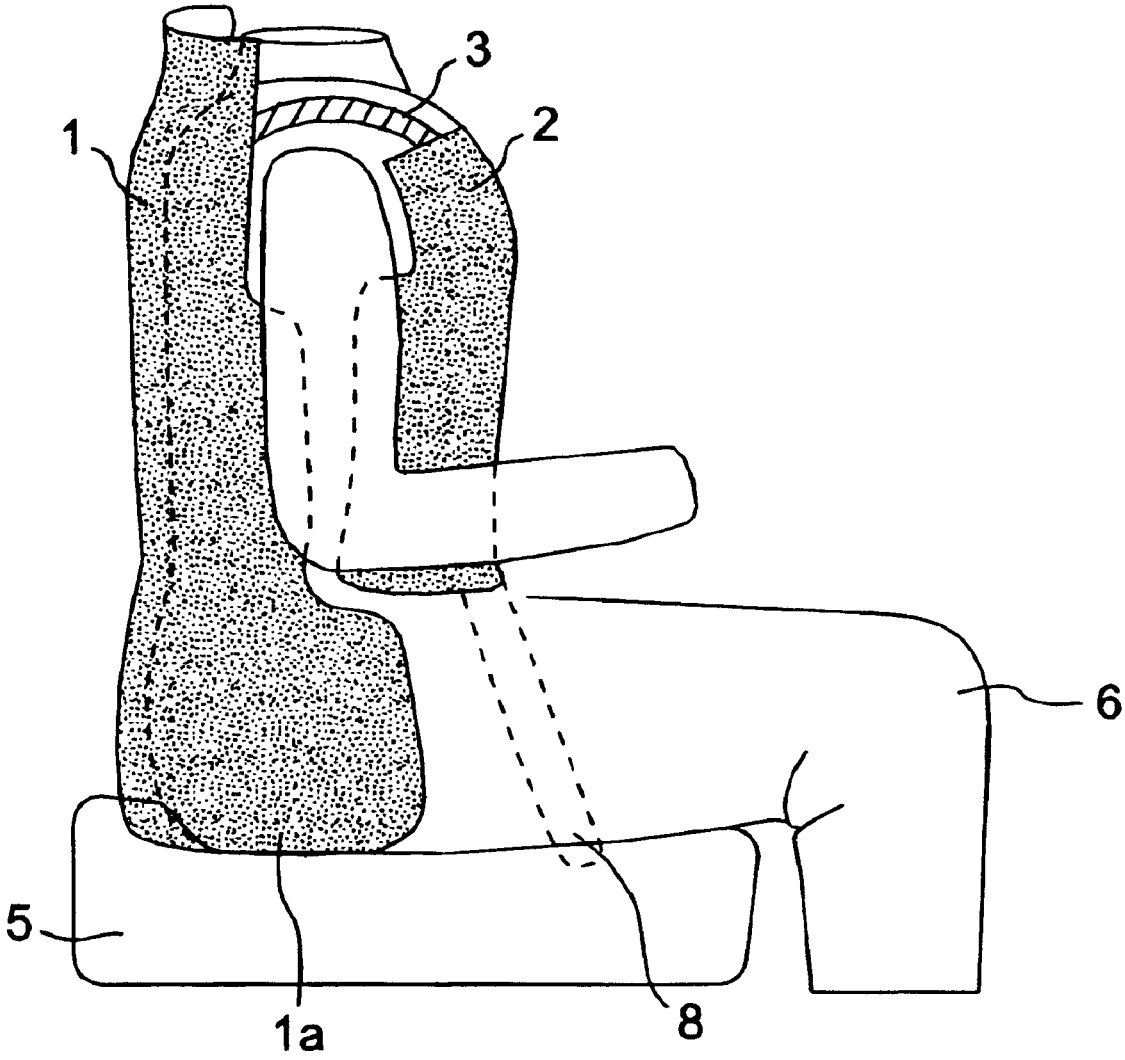
FIG. 1 is the side view of seated occupant with between-the-legs front plate support.

FIG. 1 shows the ballistic front 2 and rear 1 plates attached by shoulder straps 3 that go over the vehicle occupant and can support the ballistic armor system when the occupant is standing or out of the vehicle. The vehicle occupant is seated in the vehicle seat 5. The ballistic back plate 1 is extended at 1*a* in a design configuration that rests on the vehicle seat 5. The ballistic front plate 2 is supported by an extension of the ballistic front plate 8 that rests on the vehicle seat 5 and transfers the weight to the seat 5, which is connected to the vehicle and transfers the entire system load.

Figure 6:
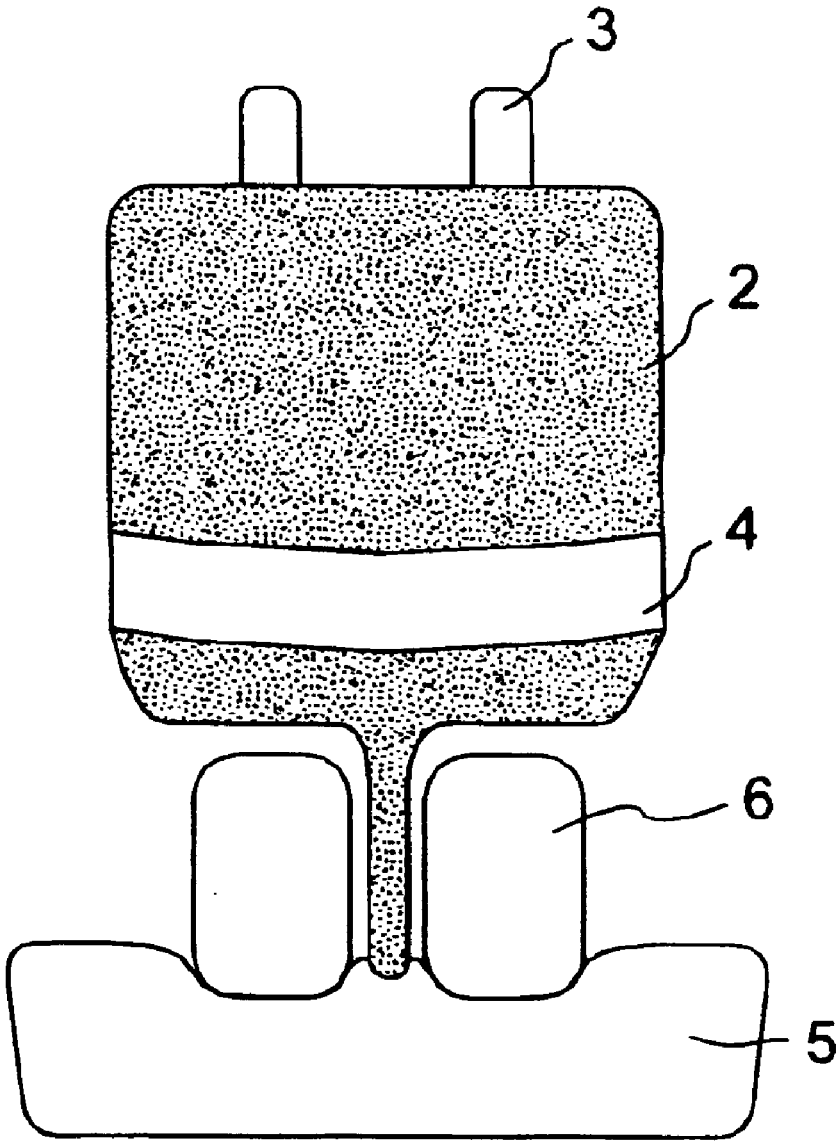
FIG. 6 is the front view of seated occupant with between-the-legs support.

FIG. 6 shows the front view of the ballistic front plate supported by an extension 8 that is positioned between-the-legs of the vehicle occupant. FIG. 6 also shows a strap 4 that can connect the front 2 and back 1 plates to keep the system together when the vehicle occupant is in or out of the vehicle. The ballistic back plate 1 can be detached from the ballistic front plate 2 by disconnecting the shoulder straps 3 and side straps 4. The back plate 1 can be left in the vehicle in its seat-mounted position. The vehicle occupant can climb into the vehicle, sits in the vehicle seat 5 then attach the ballistic front plate 2 to the system by reconnecting straps 3, 4.

b. The Ballistic Front Plate with Front Plate Supported by Back Plate Ledge.

Figure 2:
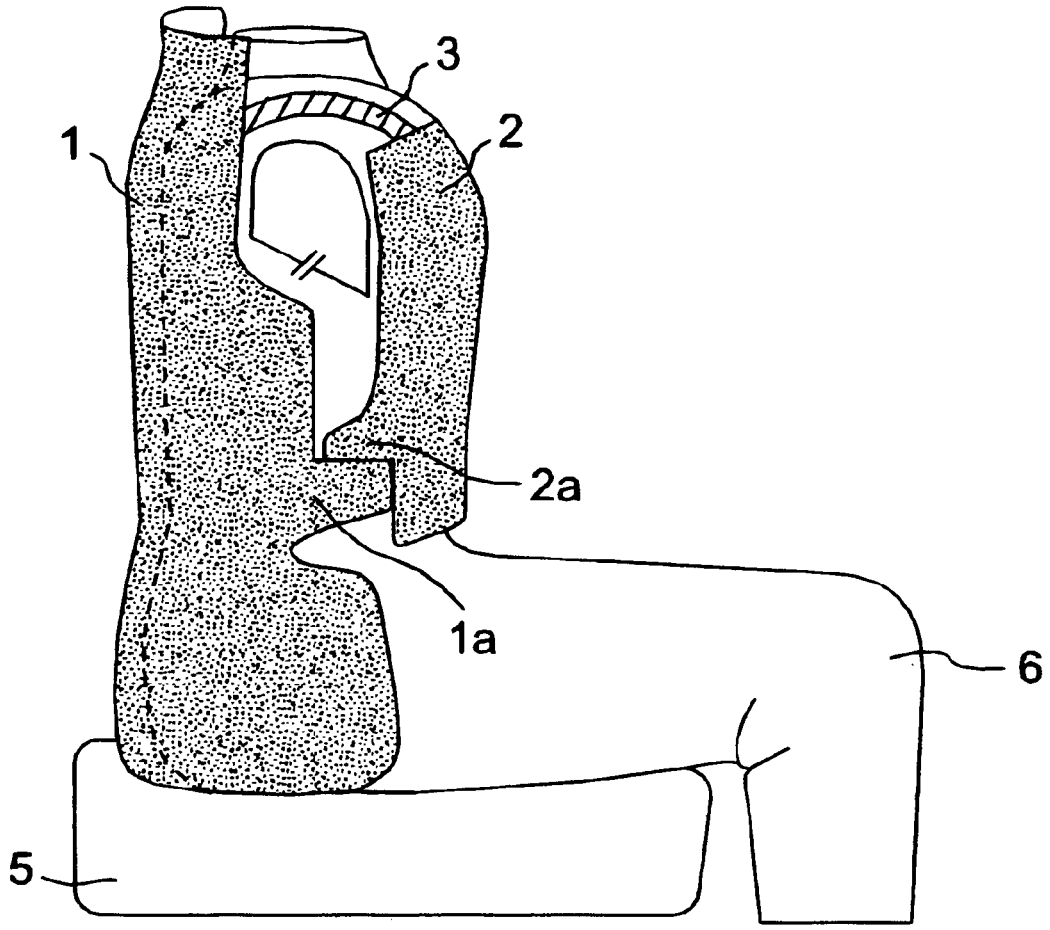
FIG. 2 is the side view of seated occupant with front plate supported by back plate ledge.

FIG. 2 shows a ballistic front plate 2 having side extensions 2*a* one of which is shown. The side extensions 2*a* are supported by side ledge extensions 1*b*, one of which is shown, extending from the ballistic back plate 1. The front 2 and back 1 plates are attached together by shoulder straps 3 and can have a mid-torso band securing the lower portions of front 2 and back 1 plates. The load from the front plate 2 is transferred to the back plate 1 through the ledge extensions 1*b*. The load is further transferred from the back plate 1 through the vehicle seat 5 to the vehicle.

c. The Ballistic Front Plate with Front Plate Support from Top.

Figure 3:
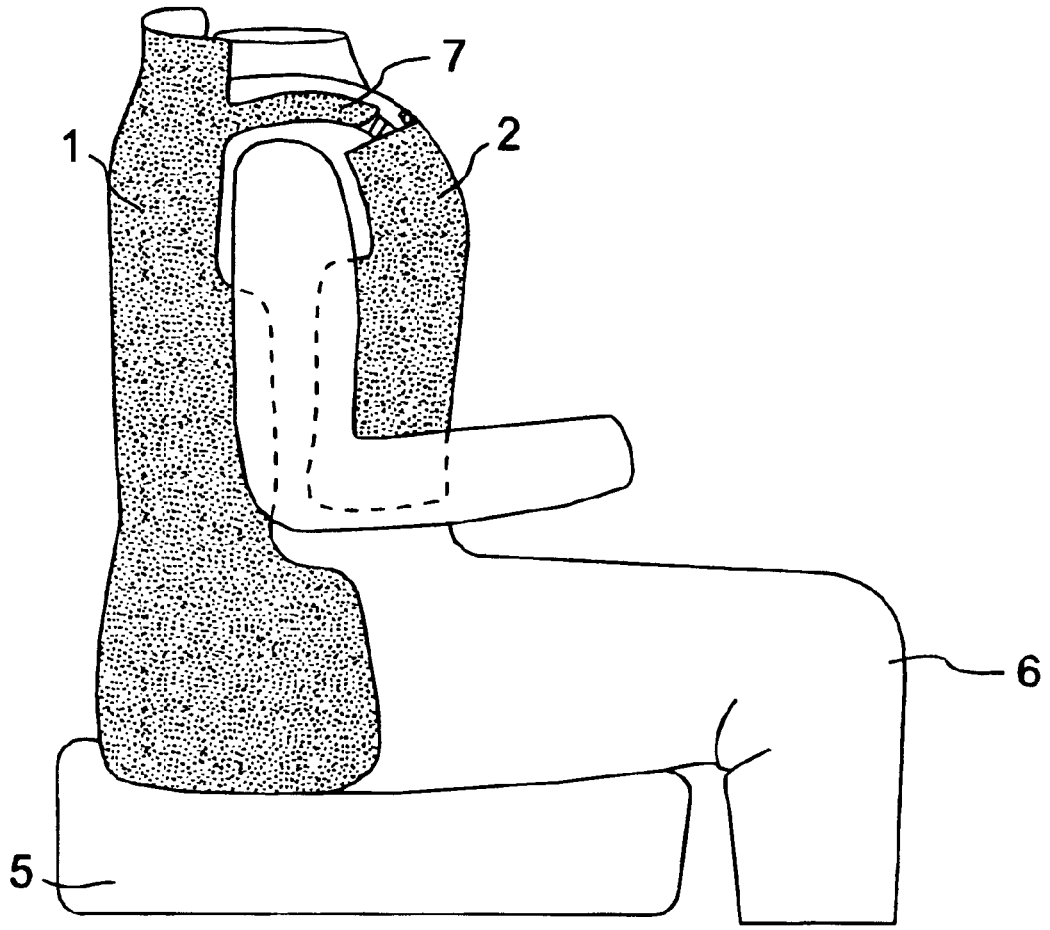
FIG. 3 is the side view of seated occupant with front plate support from top.

FIG. 3 shows the ballistic front plate 2 supported from the top by supporting arms or a structure 7 that is attached to or protrudes from the ballistic back plate 1 over the shoulders of the vehicle occupant. The load from the front plate 2 is transferred to the back plate 1 through the supporting arms 7. The load is further transferred from the back plate 1 through the vehicle seat 5 to the vehicle structure.

d. The Ballistic Front Plate with Side-of-legs Support.

Figure 4:
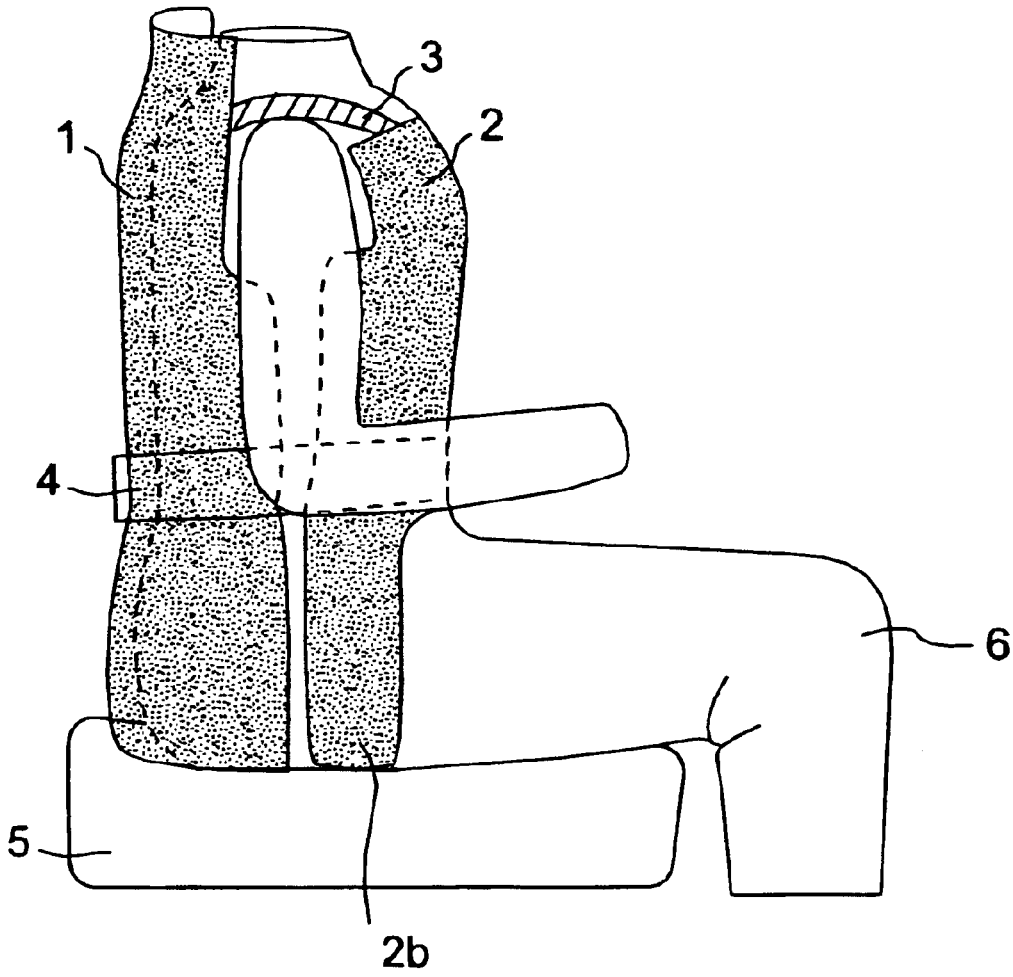
FIG. 4 is the side view of seated occupant with side-of-legs support.

FIG. 4 shows the ballistic front 2 and rear 1 plates attached by shoulder straps 3 that go over the vehicle occupant and can support the ballistic armor system when the occupant is standing or out of the vehicle. The vehicle occupant is seated in the vehicle seat 5. The ballistic back plate 1 is extended in design around the vehicle occupant's upper legs 6 to rest on the vehicle seat 5. The ballistic front plate 2 is supported by an extension 2*b* of the ballistic front plate that rests on the vehicle seat 5 and transfers the weight to the seat 5, which is connected to the vehicle and transfers the entire system load to the vehicle.

Figure 5:
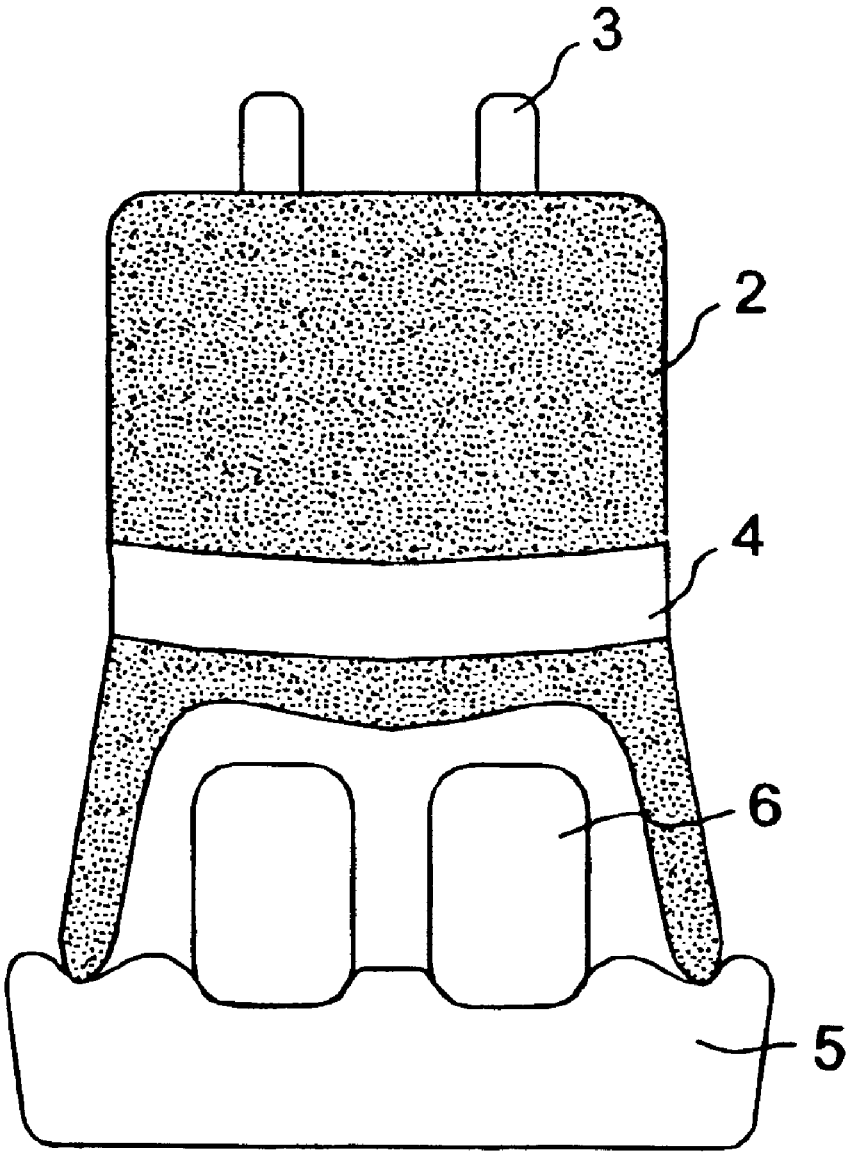
FIG. 5 is the front view of seated occupant with front plate side-of-legs support.

FIG. 5 shows the front view of the ballistic front plate supported by side extensions that are positioned at the side of the vehicle occupant's legs. FIG. 5 also shows a strap 4 that can connect the front 2 and back 1 plates to keep the system together when the vehicle occupant is in or out of the vehicle. The ballistic back plate 1 can be detached from the ballistic front plate 2 by disconnecting the shoulder straps 3 and side straps 4. The back plate 1 can be left in the vehicle in its seat-mounted position. The vehicle occupant can climb into the vehicle, sits in the vehicle seat 5 then attach the ballistic front plate 2 to the system.

ALTERNATIVE EMBODYMENTS a. Attaching the Ballistic Back Plate to the Vehicle Seat.

Figure 7:
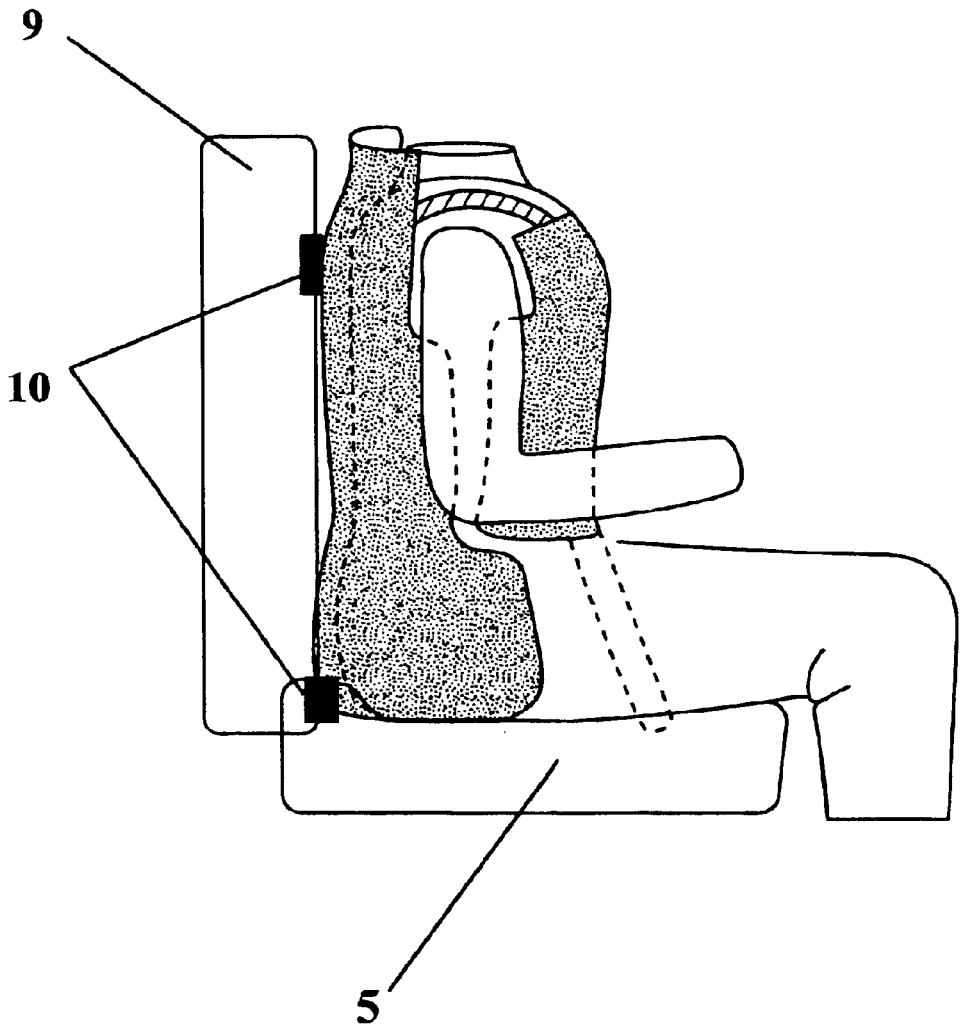
FIG. 7 is the side view of the ballistic system with the back plate attached to the seat.

FIG. 7 shows attaching the ballistic back plate 1 to the vehicle seat back 9 to attachment mechanisms 10. These attachment mechanisms can be fasteners such as quick release locks or hook-and-loop systems that allow the vehicle occupant to attach the ballistic back plate 1 to the seat for storage, normal operation, or use without the front ballistic plate 2.

b. Incorporating the Rear Ballistic Plate into the Seat Back or Serving as the Seat Back.

Figure 8:
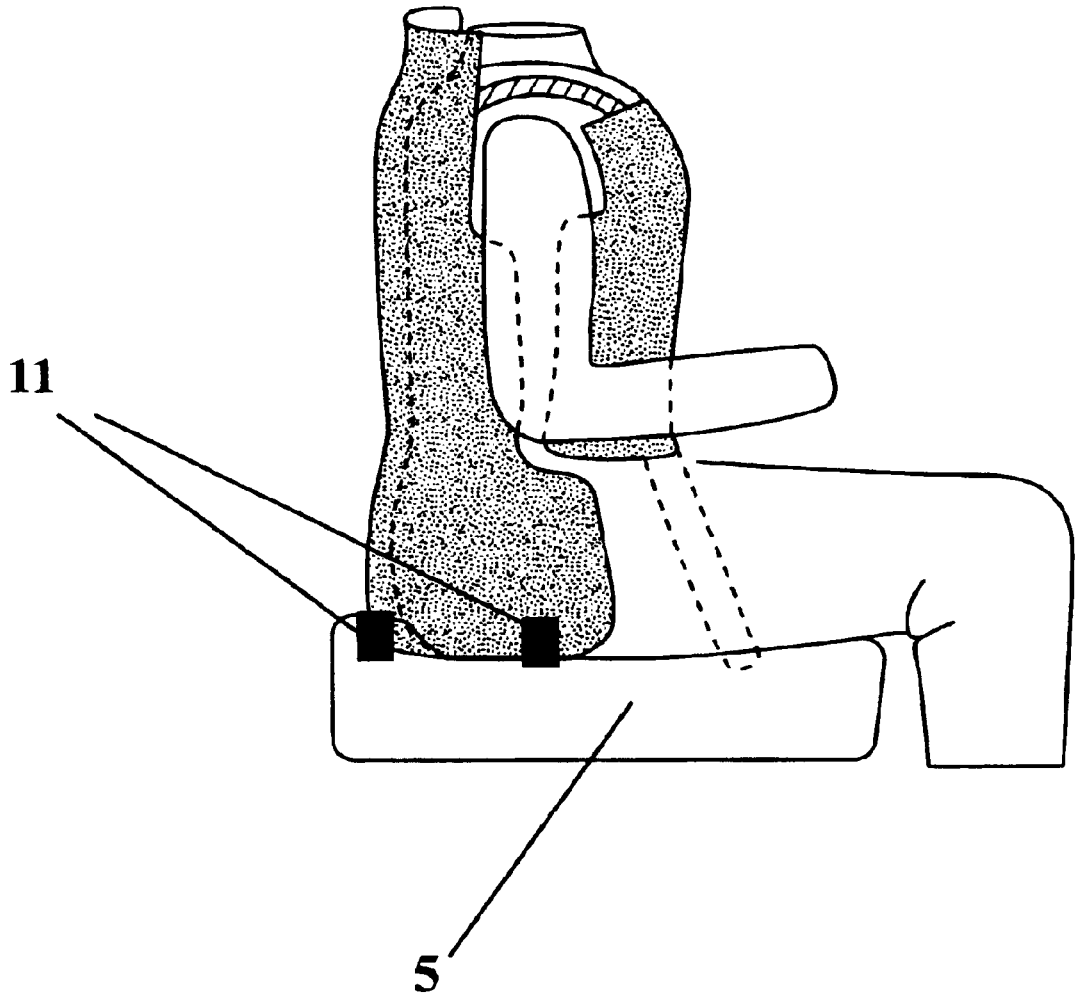
FIG. 8 is the side view of the ballistic system with the back plate used as a section of the seat.

FIG. 8 shows incorporating the rear ballistic plate 1 as the vehicle seat back. This can be accomplished through attachment mechanisms 11 that will hold the rear ballistic plate 1 in position. The attachment mechanisms 11 would be selected from a standard set of quick release mechanisms that would allow the vehicle occupant to exit the vehicle wearing the back 1 and front 2 plates.

c. Alternate Vehicle Attachment Points from Below the Vehicle Occupant.

Figure 10:
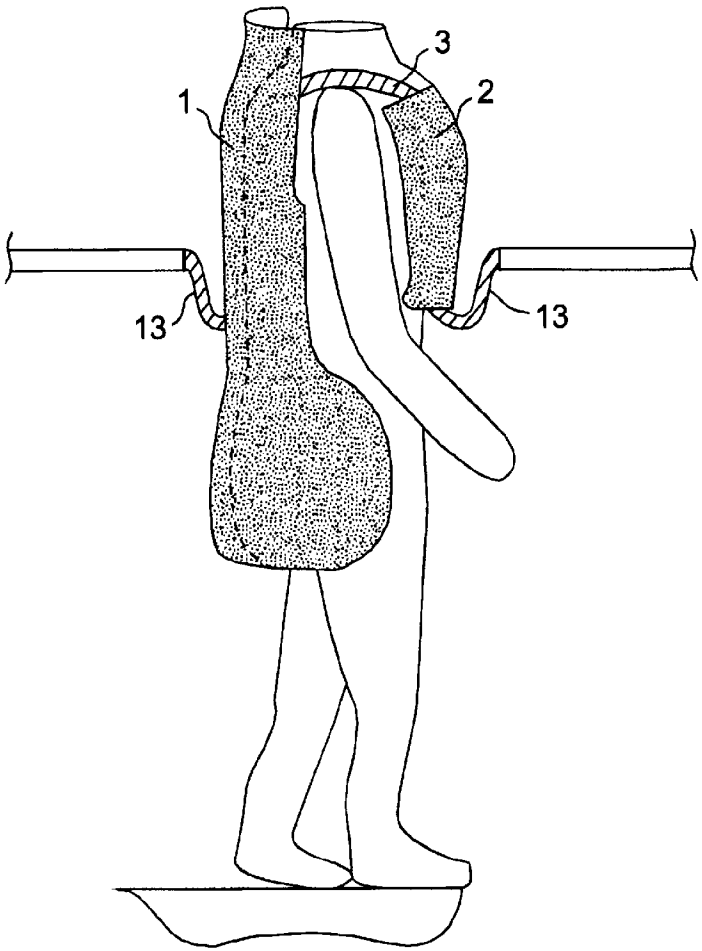
FIG. 10 is a side view of still another embodiment of the ballistic system.
Figure 9:
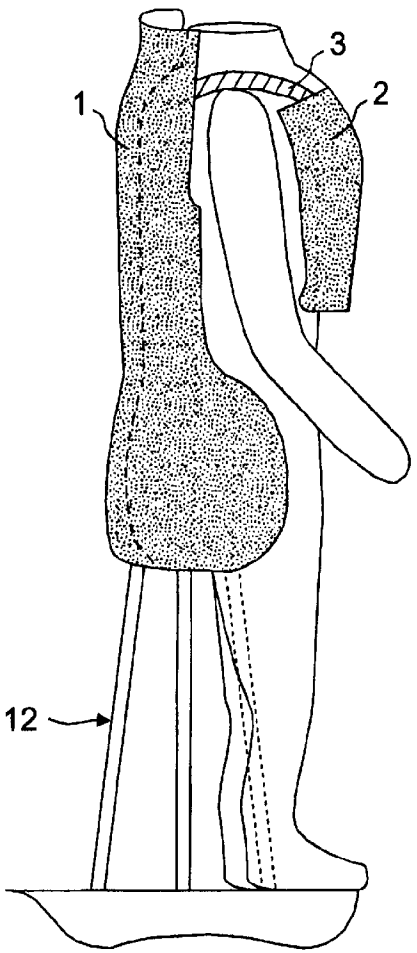
FIG. 9 is a side view of another embodiment of the ballistic system.

This invention envisions attaching the ballistic armor systems to other points in a vehicle. For situations where the occupant is not seated on a traditional seat, such as standing in a position such as a gunner's position extending out the top of a vehicle, alternated vehicle attachment points must be used. As shown in FIG. 9, a tripod support 12 provides attachments points connected to the floor of the vehicle and serve the same purpose as the seat for transferring the load to the floor of the vehicle. As shown in FIG. 10 other attachment systems could be a strap 13 from the inside of the roof gunner's hatch that could attach to the ballistic front or back plates from below the gunner since the gunner's position is above the roof.

d. Attachments from Above or to the Rear of the Vehicle Occupant.

Figure 11:
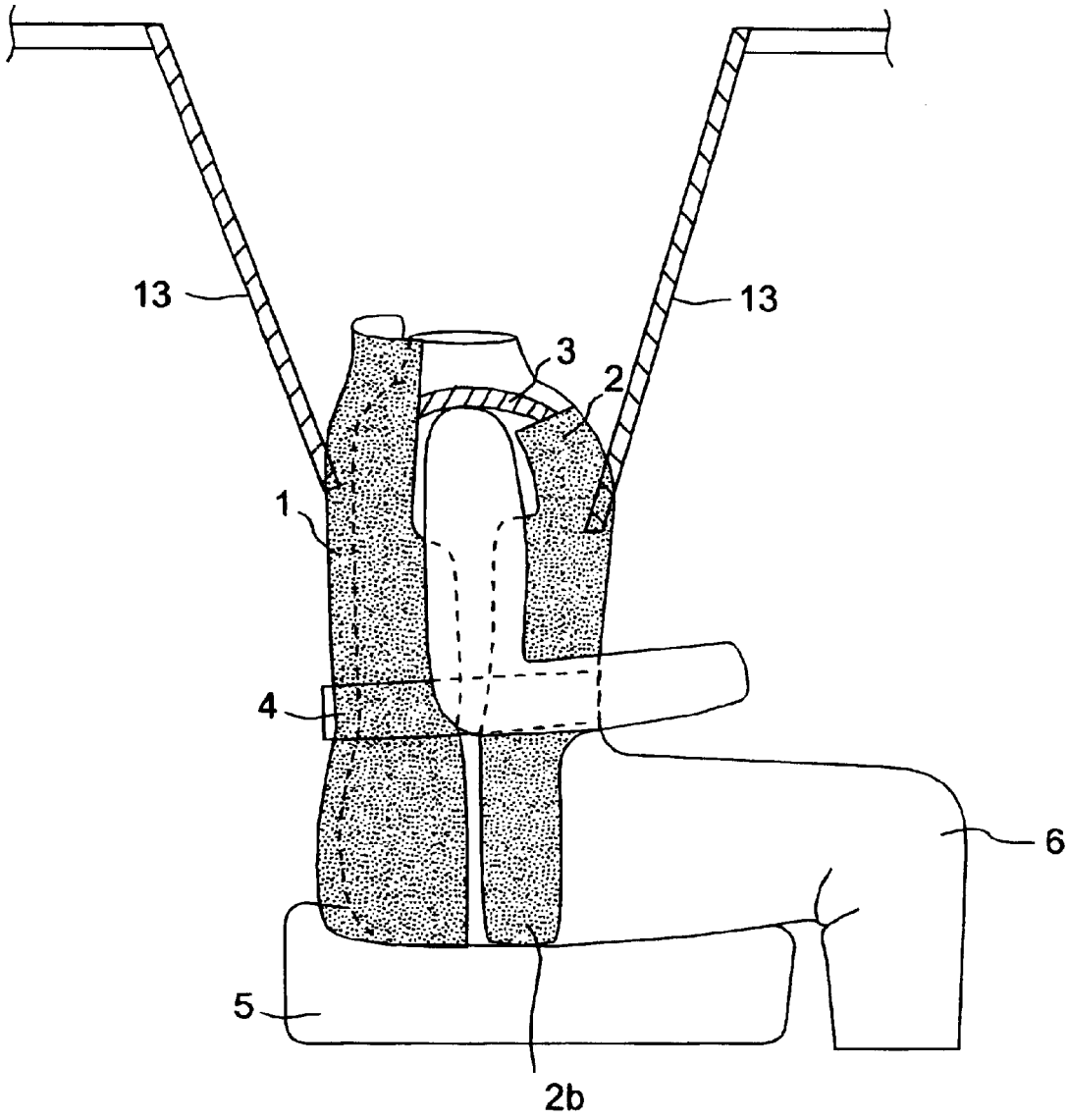
FIG. 11 is a side view of an additional embodiment of the ballistic system.

Based on vehicle design, load-transferring attachments are envisioned to be attached to the ballistic plates from above or from the rear of the vehicle occupant's normal operating position These load-transferring attachments are envisioned to be straps or elastic system 13 that will take into consideration the motion and movement the vehicle occupant encounters when riding in a vehicle such as shown in FIG. 11.

What is claimed is:

1. An armored system for vehicle occupant use, comprising a least one ballistic front ballistic plate and back ballistic plate made of a material which can stop high velocity projectiles and configured to be worn by the vehicle occupant selectively inside and outside a vehicle so as to transfer substantially all weight thereof directly to the vehicle through a vehicle seat or at least one load transfer point on the vehicle by the back ballistic plate on the seat or load transfer point of a vehicle.

2. The system of claim 1, further including a plurality of load transfer points, said back ballistic plate is connected to said at least one vehicle load transfer point for transferring the system's weight to the vehicle.

3. The system of claim 1, wherein said at least one back ballistic plate is incorporated into a vehicle seat.

4. The system of claim 1 wherein one of said at least one said front and back ballistic plate has an extended section resting on the vehicle seat.

5. The arrangement of claim 1, wherein said at least one vehicle load transfer point is operatively located between one of said at least one said front and back ballistic plate and a floor of a vehicle.

6. The arrangement of claim 1 in which said vehicle load transfer point is connected between one of said at least one said front and back ballistic plate by a hanger straps.

7. The arrangement of claim 1, wherein said at least one vehicle load transfer point is on the vehicle roof.

8. The arrangement of claim 1, wherein each said at least one vehicle load transfer point is located above said vehicle occupant.

9. The system of claim 1, wherein a ledge being provided on one of the ballistic plates said front and back to support the weight of the other ballistic plate.

10. The system of claim 1, wherein the at least one said back ballistic plate has a load transferring mechanism between upper sections thereof, for extending over the vehicle occupant's shoulder and attaching to said front ballistic plate to support the weight of said front ballistic plate.

11. The system of claim 1, wherein an attachment mechanism is provided for attaching said least one back ballistic plate to a rear vehicle seat frame.

12. An armored system for vehicle occupant use, comprising at least one front ballistic plate, a back ballistic plate and a side ballistic plate made of a material which can stop high velocity projectiles and configured to be contoured for being worn by the vehicle occupant selectively inside and outside a vehicle so as to transfer substantially all weight thereof directly to the vehicle through a vehicle seat or to at least one load transfer point on the vehicle by one of the front, back, or side ballistic plates on the seat or through one load transfer point on the vehicle.

* * * * *